US007784204B2

(12) United States Patent
Staats et al.

(10) Patent No.: US 7,784,204 B2
(45) Date of Patent: Aug. 31, 2010

(54) ARTIFICIAL WINDOW

(75) Inventors: Cornelis Titia Staats, Eindhoven (NL); Lars Rene Christian Waumans, Eindhoven (NL); Gerrit Jan Teije Huijgen, Eindhoven (NL); Piet Antonis, Eindhoven (NL); Joseph Franciscus Raymond Eijsermans, Eindhoven (NL); Onno Van Tertholen, Eindhoven (NL); Adrianus Sempel, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 332 days.

(21) Appl. No.: 11/915,622

(22) PCT Filed: May 30, 2006

(86) PCT No.: PCT/IB2006/051710

§ 371 (c)(1),
(2), (4) Date: Nov. 27, 2007

(87) PCT Pub. No.: WO2006/129268

PCT Pub. Date: Dec. 7, 2006

(65) Prior Publication Data

US 2009/0273302 A1 Nov. 5, 2009

(30) Foreign Application Priority Data

| | | |
|---|---|---|
| Jun. 1, 2005 | (EP) | 05104714 |
| Oct. 7, 2005 | (EP) | 05109349 |
| Mar. 1, 2006 | (EP) | 06110558 |

(51) Int. Cl.
*G09F 13/18* (2006.01)

(52) U.S. Cl. ..... 40/546; 40/564; 362/125

(58) Field of Classification Search ..... 40/427, 40/546, 553, 564, 573; 362/147, 223, 224, 362/217.1, 217.11, 227, 246, 255, 256, 125
See application file for complete search history.

(56) References Cited

U.S. PATENT DOCUMENTS

| | | | | |
|---|---|---|---|---|
| 1,607,922 A | | 11/1926 | Schweitzer | |
| 4,418,378 A | * | 11/1983 | Johnson | 362/217.08 |
| 4,674,211 A | * | 6/1987 | Pratt | 40/564 |
| 5,251,392 A | * | 10/1993 | McManigal | 40/427 |
| 5,253,051 A | | 10/1993 | McManigal | |
| 5,426,879 A | * | 6/1995 | Hecker | 40/427 |

(Continued)

FOREIGN PATENT DOCUMENTS

| | | |
|---|---|---|
| EP | 1052364 | 11/2000 |

(Continued)

*Primary Examiner*—Thuy Vinh Tran

(57) ABSTRACT

Disclosed is an artificial window (1) comprising a light box (10) having a rear wall (11) and a planar diffuser arrangement (14) in front of the rear wall (11). The artificial window further comprises at least one first light source (13) extending between the rear wall (11) and the diffuser (14); a window frame (20) in front of the diffuser (14); and drivers (15, 28) arranged for operating the light source (13) and electrically connected to the light source (13). The artificial window also comprises at least one additional light source (25) electrically connected to one of said drivers (28), which additional light source (25) radiates light in substantially one direction and is arranged to radiate light onto a portion of the front side of the diffuser arrangement (14) during operation.

12 Claims, 5 Drawing Sheets

U.S. PATENT DOCUMENTS 5,722,754 A 3/1998 Langner

FOREIGN PATENT DOCUMENTS

| | | |
|---|---|---|
| FR | 2730294 | 8/1996 |
| GB | 2223565 | 4/1990 |
| JP | 2001167607 | 6/2001 |
| JP | 2001176679 | 6/2001 |
| JP | 2002089912 | 3/2002 |
| WO | 9213474 | 8/1992 |
| WO | 03098659 | 11/2003 |

* cited by examiner

ARTIFICIAL WINDOW

This application is a national phase application filed under 35 U.S.C. 371 claiming the benefit of PCT/IB2006/051710 filed on May 30, 2006, which has foreign priority benefits of applications EPO-05104714.0 filed on Jun. 1, 2005; EPO-05109349.0 filed on Oct. 7, 2005; and EPO-06110558.1 filed on Mar. 1, 2006.

The invention relates to an artificial window comprising:

a light box having a rear wall and a diffuser arrangement in front of the rear wall screening said rear wall from a window frame in front of the diffuser arrangement, said light box further containing:

at least one first light source extending between the rear wall and the diffuser arrangement;

a first set of drivers for operating the at least one light source.

The invention further relates to a method for operating an artificial window.

An embodiment of such an artificial window is known from GB-A-2 223 565. There are numerous public or office buildings having apartments which lack windows through which daylight can enter, e.g. control rooms, conference rooms, waiting rooms in hospitals, shops, archives, libraries. When people are present in such rooms, the absence of windows causes a drop in their efficiency. Moreover, in many countries regulations forbid a prolonged presence in such rooms. It is therefore of interest to have available a luminaire which imitates a window through which daylight enters.

A number of elongate fluorescent lamps are vertically arranged in the known artificial window when this is mounted against a wall. The lamps emit white light of a color temperature of 3000K. The diffuser is kept enclosed by the light box and the window frame. When the lamps are lit, a bright white screen surrounded by the window frame is observed, which is recommended for the treatment of patients suffering from depressions.

In this respect, the known artificial window offers little more than opalescent screens having similar lamps at the rear, which screens are to be placed on a table or a desk to provide a light shower. It simulates a blank screen lit by the sun e.g. at noon.

It is a disadvantage of the known artificial window that it provides only a poor imitation of a real window.

It is an object of the invention to provide an artificial window of the kind described in the opening paragraph which is able to give a more realistic impression of a window through which light enters at daytime.

According to a first aspect of the invention, the artificial window further comprises at least one additional light source electrically connected to a second set of drivers, which additional light source radiates light in substantially one direction and during operation is arranged to radiate light on a portion of a front side of the diffuser arrangement facing the window frame and/or to radiate light through a transparent plate of the window frame.

By combining diffuse backlight with light radiation or a front projection in substantially one direction various effects may be obtained which give the user a realistic window experience. Light radiation in substantially one direction in this respect means that the additional light source emits a spotlight-type beam of light having a beam angle in the range of 5° to 40°, preferably in the range of 10° to 30°. Such effects may comprise an impression of moving clouds, the moving sun, falling rain, shadows of trees and objects, etc. It was found that, in order to give the user a realistic window experience, the effects preferably do not involve high-resolution images which imitate a clear window pane, but rather vague impressions of the outside world which imitate a milky window pane.

The at least one additional light source is preferably present between the planes of the diffuser arrangement and the window frame, so that the window frame may be sold in one piece. It was also found that light incident on the diffuser arrangement at an acute angle gave very satisfactory results. Preferably, the center of the radiation beam of the additional light source is aimed at the front side of the diffuser arrangement, and preferably the direction of the radiation beam of the additional light source and/or the position of this source can be changed by means of said driver. The at least one additional light source may further be movable along a rail which extends between the first and the second frame portions, for example in order to adapt to various stages of the day.

The lamp type of the at least one additional light source is preferably chosen from the group comprising HID (high intensity discharge lamps), TL (fluorescent lamps), LED (light emitting diodes), CFL (compact fluorescent lamps), incandescent lamps (e.g. GLS) or halogen incandescent lamps. Preferably, a plurality of additional light sources is present, wherein at least two light sources are of a different lamp type, so that a wide variety of effects may be obtained.

At least one of the additional light sources is preferably of the projection type and comprises a projection lens and a slide comprising a shape, pattern, or image, the additional light source being arranged to project said shape, pattern, or image onto the diffuser. Preferably, said slide is a dynamic slide, such as an LCD projection device. Said dynamic slide may be further arranged to project texts on the diffuser.

In addition, one of the additional light sources may comprise a dynamically changing color filter. The additional light source may further comprise at least a movable mirror, which mirror is arranged to move the radiation beam of the light source over the diffuser.

The diffuser arrangement preferably comprises a diffuser and a holographic foil in front of the diffuser, at a distance therefrom, onto which the additional light sources project. Holographic foil is substantially transparent when no light is incident on it, but will reflect light in a diffuse manner when light is projected onto it. This provides a three-dimensional effect which adds to the realistic experience of the artificial window.

According to a further aspect of the invention, the light sources comprise a first set of light sources emitting red light during operation, a second set of light sources emitting green light during operation, and a third set of light sources emitting blue light during operation, the light sources of the first set, of the second set, and of the third set being mounted in a mixed arrangement, while the drivers are also capable of dimming the light sources and are each connected to at most a respective portion of the number of light sources of a set and are capable of controlling said sets individually, while a transparent plate is present in the window frame, remote from the diffuser.

This combination of features gives the artificial window of the invention a more realistic appearance of a daylight window during operation. The light sources of different colors and the possibility to operate them also in a dimmed mode render it possible to create a window of several color temperatures, corresponding to the time of day and the season. The window can emit light of different color temperatures at sunset and at noon.

The actual light generated by the window can be chosen by the user. Moreover, the window provides the possibility to produce color patterns, which is not to be interpreted as pictures. A lower portion of the window mounted to a wall may be, for example, green, a higher portion may be blue or purple. An impression of the horizon can be created in that manner.

A window has a pane through which light enters and which can be looked through. The transparent plate, which may be of glass or of an artificial resin, such as polymethylmethacrylate, acrylic glass, behind which the diffuser is present at a distance and through which a rear portion of the window frame is observable, creates depth, the third dimension, which contributes to the impression of a real window. Additionally, it gives the reflections which are normal to window panes.

The artificial window of the invention may be mounted, for example, to a vertical wall or to a sloping wall portion against the inside of a roof.

In an embodiment, the window frame has a first and a second, opposing frame portion at a mutual distance d and respective panels extending therefrom towards the diffuser. The panels are illuminated when the window is in operation. They enhance the realistic, three-dimensional impression of the window. The panels may have a brick finish and pattern to imitate a reveal, the boundary of a recess in a façade in which a window is mounted. The panels may alternatively have a finish imitating concrete, planks, metal, or other materials of which the facade of a building is made. The panels may alternatively have a board or plywood finish, e.g. if the window is to be mounted against a beveled wall to imitate a roof window.

It is an advantage to have the panels extend towards but not up to the diffuser, although it is possible in the artificial window of the invention for panels to extend up to the diffuser. If the panels do not touch the diffuser, the impression of space, of three dimensions, is enhanced. The suggestion then is that it would be possible to look beyond the panels to the right or to the left if the transparent pane were not in position and one could lean out of the window.

It is favorable to improve the realistic, three-dimensional effect of the window further by giving the panels a mutual distance D which is greater than d.

They are then not directly beside and behind the window pane, but displaced sideways, e.g. to join the outside extremity of the frame portion.

The building in which the artificial window is or will be used may require that the first and the second frame portions are curved along at least part of their lengths, e.g. so as to meet one another in the middle.

In an embodiment, a processor is coupled to the drivers of the light sources to control the drivers in response to a signal received by a user interface. A few basic data, such as the time of day, brightness, and pattern, can then be put in to achieve the desired appearance of the window. The input may be given to the user interface of the window manually, via a remote control, or via signals from an outside sensor.

In a modification of this embodiment, a memory is coupled to the processor, which memory contains programs to be executed by the processor in response to a signal received by the user interface. This facilitates the use of the window, as now a program can be chosen that meets the user's desires. For instance, a program may cause the window to display an imitation of the light changing in brightness and color from sunrise to noon to sunset, or a portion thereof, e.g. in real time. The memory may be integral with the processor.

The light sources at the back of the diffuser arrangement may be, for example, light emitting diodes (LEDs), or particularly fluorescent lamps. These lamps have a high yield and are easily available. T5 fluorescent lamps, lamps having a diameter of about 15 mm, are particularly suitable also because of their relatively small volume. Each fluorescent lamp generally has its own driver or two adjacent lamps have a driver in common. In the case of LEDs, a few neighboring LEDs of the same color may share a driver.

In an embodiment, the light box contains elongate fluorescent lamps as back light sources, and these lamps extend transversely to the first and the second frame portions. In this embodiment, a light pattern as described above, in which the horizon is imitated, can easily be achieved even with lamps which are about as long as the width of the window. If shorter lamps are used, e.g. of lower power consumption, or lamps comprising two parallel tubular portions, as is the case with so-called PL lamps, the light pattern of the window can also be segmented in the longitudinal direction of the lamps, which generally will be the horizontal direction. This is of interest in simulating the position of the sun. It is favorable if the lamps are able to consume a power of about 400 to about 650 W per square meter of rear wall surface.

In a favorable embodiment of the window of the invention, at least one additional lamp provided with a reflector is present between the diffuser and the window frame adjacent a third frame portion which bridges the first and the second frame portion, concealed by the frame, coupled to an own driver for starting, operating, and dimming, and directed so as to radiate light through the transparent plate during operation. This additional lamp, the light beam of which is preferably movable by means of motors, may also be used as the additional light source in accordance with the first aspect of the invention, in which case the light beam is directed towards the diffuser during at least a part of its operation. In this embodiment, the window is designed to be mounted with the third frame portion at the top. It is favorable if a high-pressure discharge lamp, such as a metal halide discharge lamp in a ceramic discharge vessel, e.g. of 70 W and of a color temperature of 3000 or 4000K, or a white light emitting high-pressure sodium lamp, e.g. of 100 W, or alternatively a halogen incandescent lamp, e.g. of 150 W, is present. These lamps are available in compact sizes and their light sources are is compact, enabling the associated reflector, which may be integral or assembled with the lamp, to shape the light generated by the lamp into a beam, which may be narrow and well-defined.

Depending on the orientation of the lamp and the reflector, the beam enters the apartment in which the window is mounted only, or also hits and illuminates a portion of the window frame. Inside the apartment the beam may create shadows of bodies present adjacent the window, thereby further enhancing the impression of a real daylight window. The use of a halogen incandescent lamp has the advantage that dimming lowers its color temperature.

The lamp used may be a high-pressure metal halide discharge lamp having a ceramic discharge tube and a filling comprising sodium iodide and cesium iodide, in combination with a driver generating an AC current with a variable DC component through the lamp. Such lamps and drivers are known from WO 03/098.659. By varying the DC component of the current, the driver causes the lamp to vary the color of the light generated. The color changes are based on de-mixing of the filling of the lamp.

In a modification of this embodiment, the at least one additional light source and/or the additional lamp is movable along a rail which extends between the first and the second frame portions. The light source or lamp may be caused to change its angle to these frame portions, while moving along the rail. In this modification, the relative movement of the sun is strongly emphasized. The lamp may simulate, for example, first a period early in the morning in which the sun is in a low position with respect to the earth, hardly entering the apartment but illuminating the right-hand vertical portion of the window rather high up, with the lamp positioned near the left-hand upper corner of the window. Later on, the lamp may be directed to have the beam illuminate the vertical window frame portion lower down and to enter the apartment, and still later to throw the beam from a position in the middle of the window less far into the apartment. This feature enhances the realistic, dynamic character of the window in creating dynamically changing patterns on the diffuser.

In a modification of this embodiment, several lamps provided with respective reflectors are present, each at its own angle to the first and the second frame portion. These lamps may be switched to be operated in alternation.

In a further embodiment, a fourth frame portion is present opposite the third frame portion, a shelf being present adjacent the fourth frame portion. This shelf represents a window sill. When objects are placed thereon, a shadow is created which enhances the illusion of the artificial window being a real window. If so desired, curtains and/or a lamellae screen may be added when the artificial window has been mounted in place.

The artificial window may be applied not only against a—possibly beveled—wall, but also in a corner formed by two walls or in the corner of a wall and a ceiling. To this end, it is of interest that the artificial window should be shaped to fit in a corner between two constructional planes which are at right angles to one another.

The invention furthermore relates to a method of operating an artificial window comprising a light box having a rear wall and a planar diffuser arrangement in front of the rear wall, at least one first light source extending between the rear wall and the diffuser; and a window frame in front of the diffuser; wherein at least one additional light source, which radiates light in substantially one direction, is arranged to radiate light onto a portion of the front side of the diffuser arrangement.

Embodiments of the artificial window of the invention will be described and further elucidated with reference to the drawings, in which.

Figure 5:
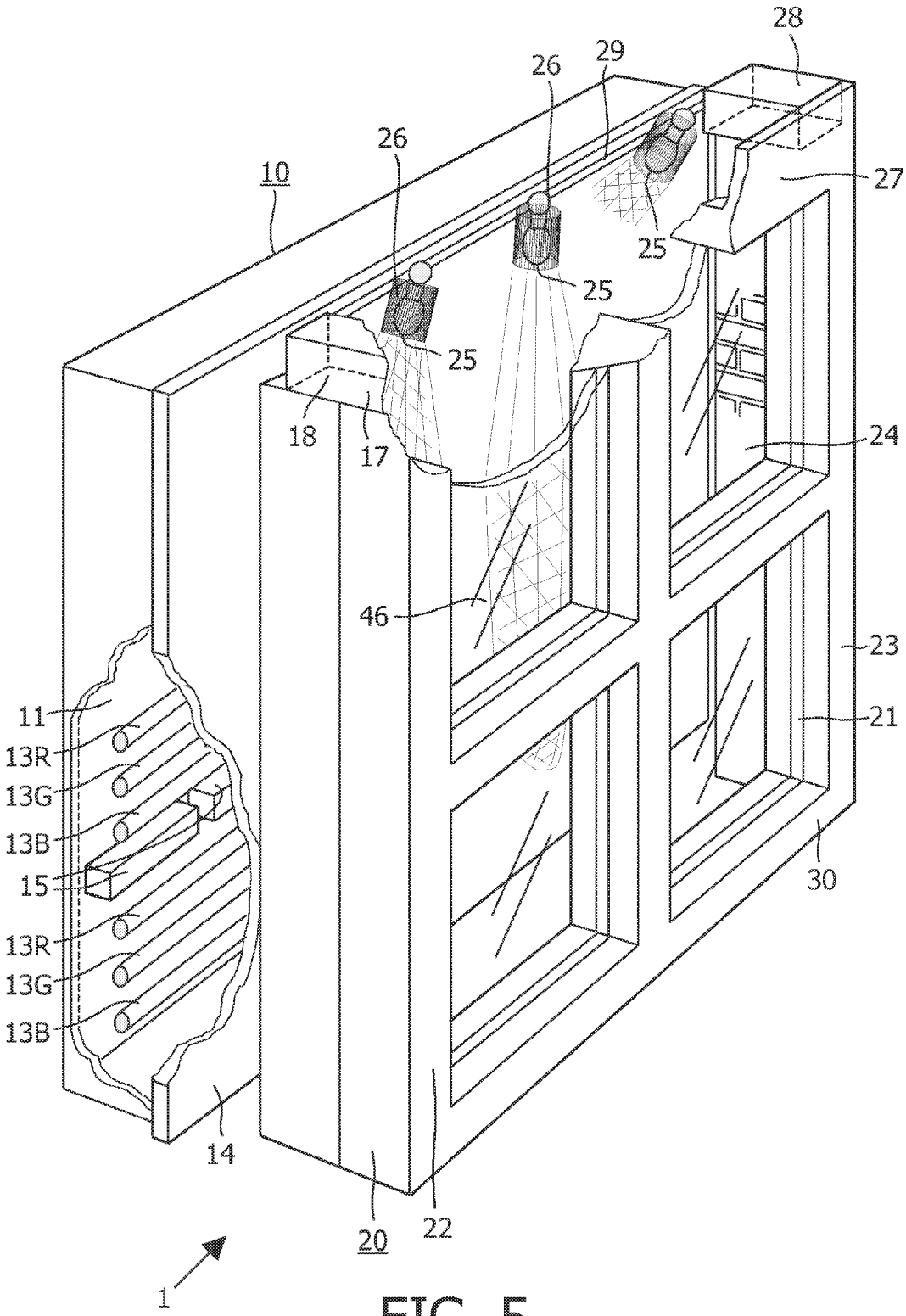

FIG. 5 diagrammatically shows a further embodiment, partly broken away.

Figure 1:
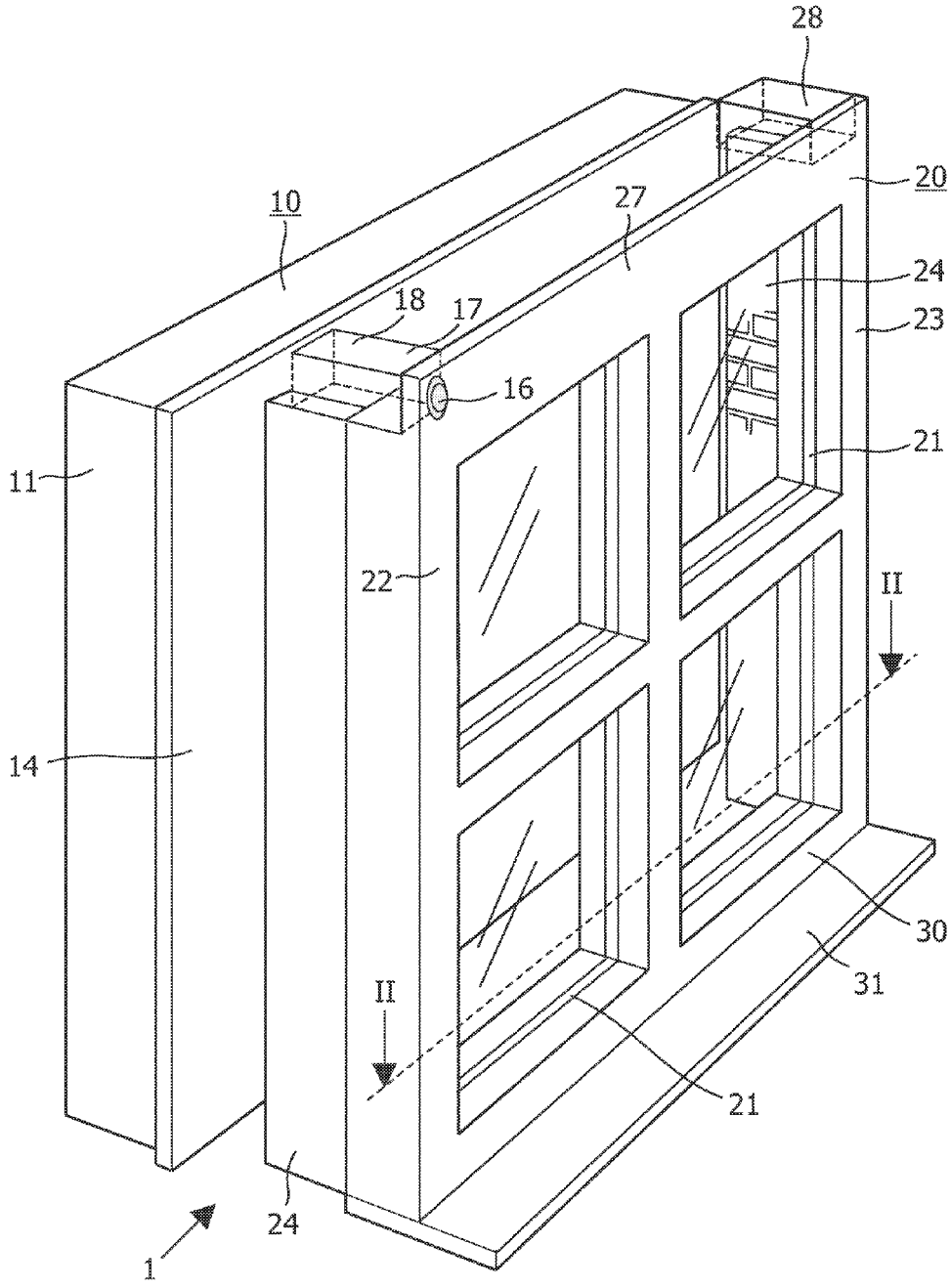
FIG. 1 is a diagrammatic perspective view of a first embodiment.
Figure 2:
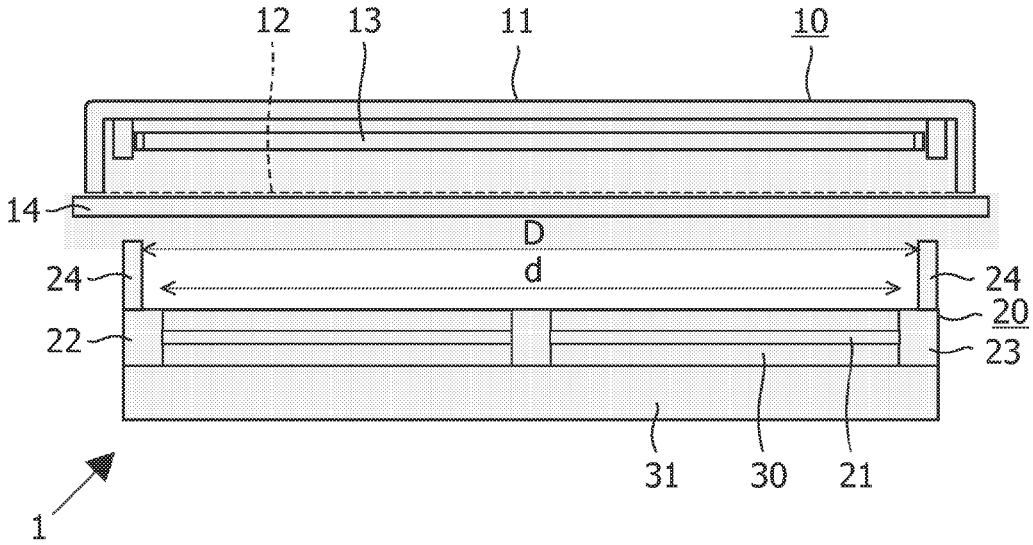
FIG. 2 is a cross section taken on the line II-II in FIG. 1.
Figure 3:
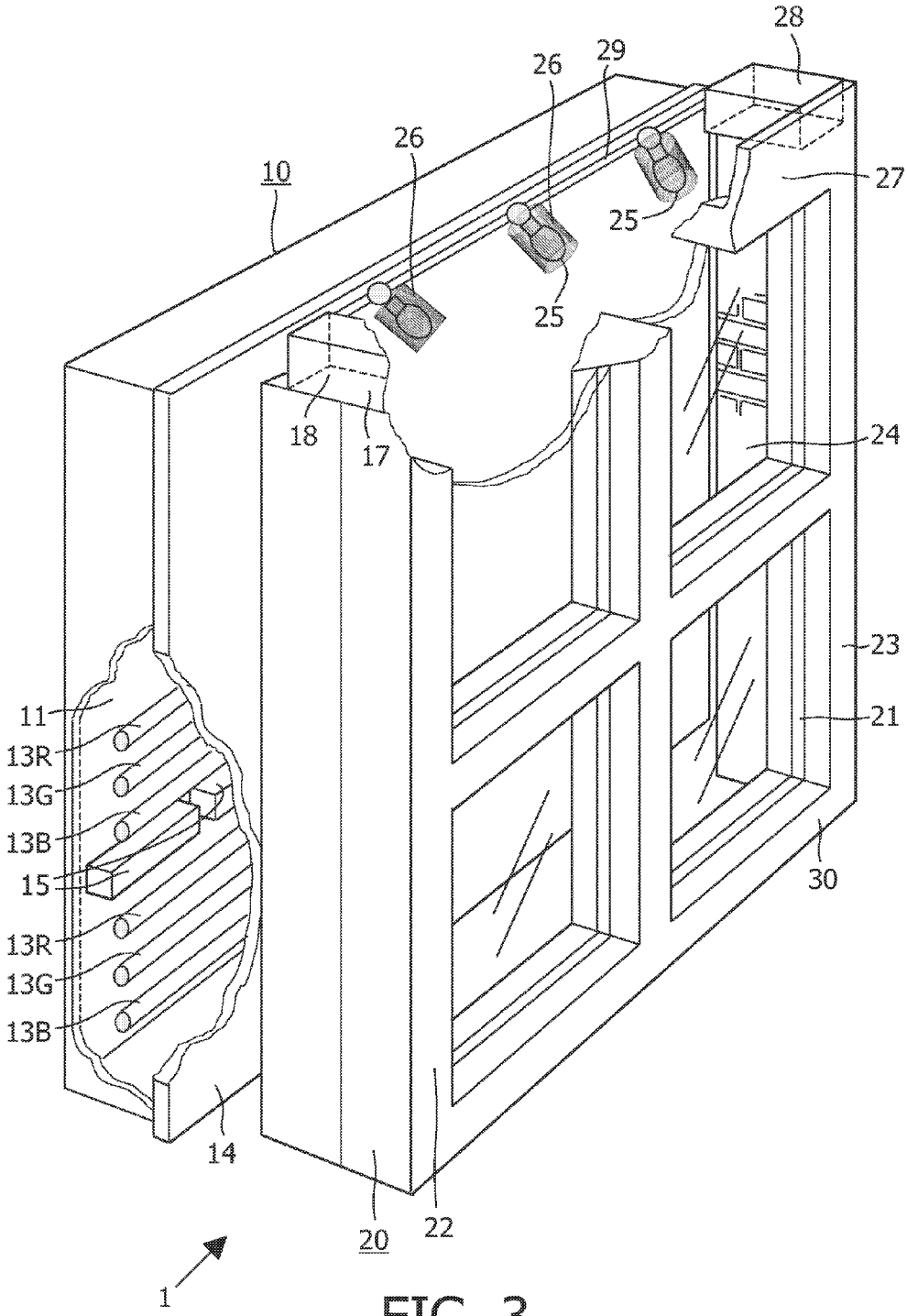
FIG. 3 shows the embodiment of FIG. 1 partly broken away.

In the embodiment of FIGS. 1, 2, 3, and 5, the artificial window 1 has a light box 10, see FIGS. 2 and 3, having a rear wall 11 and a light exit window 12 opposite the rear wall 11. The light box is made of reflective material, in the Figs. of metal sheeting having a white, highly reflective coating which has a diffusing reflection component, e.g. of the kind normally applied in luminaires. A plurality of electric light sources 13 are mounted in the light box 10 adjacent the rear wall 11. In the Figs. the light sources 13 are tubular fluorescent lamps of 15 mm diameter. A diffuser 14 of opalescent polyacrylate is present adjacent the light exit window. A window frame 20 is mounted in front of the diffuser 14. The window frame 20 may consist of wood, synthetic resin, or aluminum, for example, but at least an appearance as of wood is preferred. Drivers 15 for starting and operating the light sources are electrically connected to the light sources 13. The artificial window 1 has a user interface 16 for receiving command signals.

The light sources 13, see FIGS. 3 and 5, comprise a first set of light sources emitting red light 13R during operation, a second set of light sources emitting green light 13G during operation, and a third set of light sources emitting blue light 13B during operation. The light sources 13R of the first set, 13G of the second set, and 13B of the third set are mounted in a mixed arrangement. The drivers 15 are also able to dim the light sources 13 and they are each connected to at most a respective portion of the number of light sources 13R, 13G, 13B of a set. In the embodiment shown, each light source 13 has its own driver 15. The drivers 15 are capable of being controlled individually. A transparent plate 21 is present in the window frame 20, remote from the diffuser 14.

In the Figs., a crossbar is present in the window frame 20, but this is not essential. The crossbar divides the transparent plate 21, a glass pane in the Figs., into four portions, virtually or in fact. The window frame 20 has a first 22 and a second, opposing frame portion 23 at a mutual distance d and respective panels 24, see FIG. 2, extending therefrom towards the diffuser 14. The panels 24 have a pattern and a brick finish.

In the embodiment shown, the panels 24 have a mutual distance D which is greater than d.

A processor 17 is coupled, for example electrically, to the drivers 15 of the light sources so as to control the drivers in response to a signal received by the user interface 16. Cabling is left out in the Figs. for reasons of clarity.

A memory 18 is coupled to the processor 17. The memory 18 contains programs to be executed by the processor 17 in response to a signal received by the user interface 16. The processor 17 and the memory 18 are integrated.

The elongate fluorescent lamps that serve as light sources 13 extend transversely to the first and the second frame portions 22, 23.

At least one lamp 25, see FIGS. 3 and 5, provided with a reflector 26 is present between the diffuser 14 and the window frame 20, adjacent a third frame portion 27 which bridges the first and the second portions 22, 23, concealed by the frame 20 and coupled to an own driver 28. In FIG. 3, the lamps 25 are directed to radiate light through the transparent plate 21 during operation. In FIG. 5, the lamps 25 are directed to radiate light onto the front side 46 of the diffuser 14 during operation.

The at least one lamp 25 is movable along a rail 29 which extends between the first and the second frame portions 22, 23 while changing its angle to these frame portions 22, 23. FIGS. 3 and 5 show three such lamps 25 and reflectors 26, indicating some of the positions said at least one lamp 25 may occupy but also illustrating an embodiment in which several lamps 25 are present. In the latter case, mounting to a rail is not necessary if the lamps need not be moved.

In FIG. 1, the window frame 20 has a fourth frame portion 30 opposite the third frame portion 27, and a shelf 31 is present adjacent the fourth frame portion 30 as a windowsill.

Figure 4:
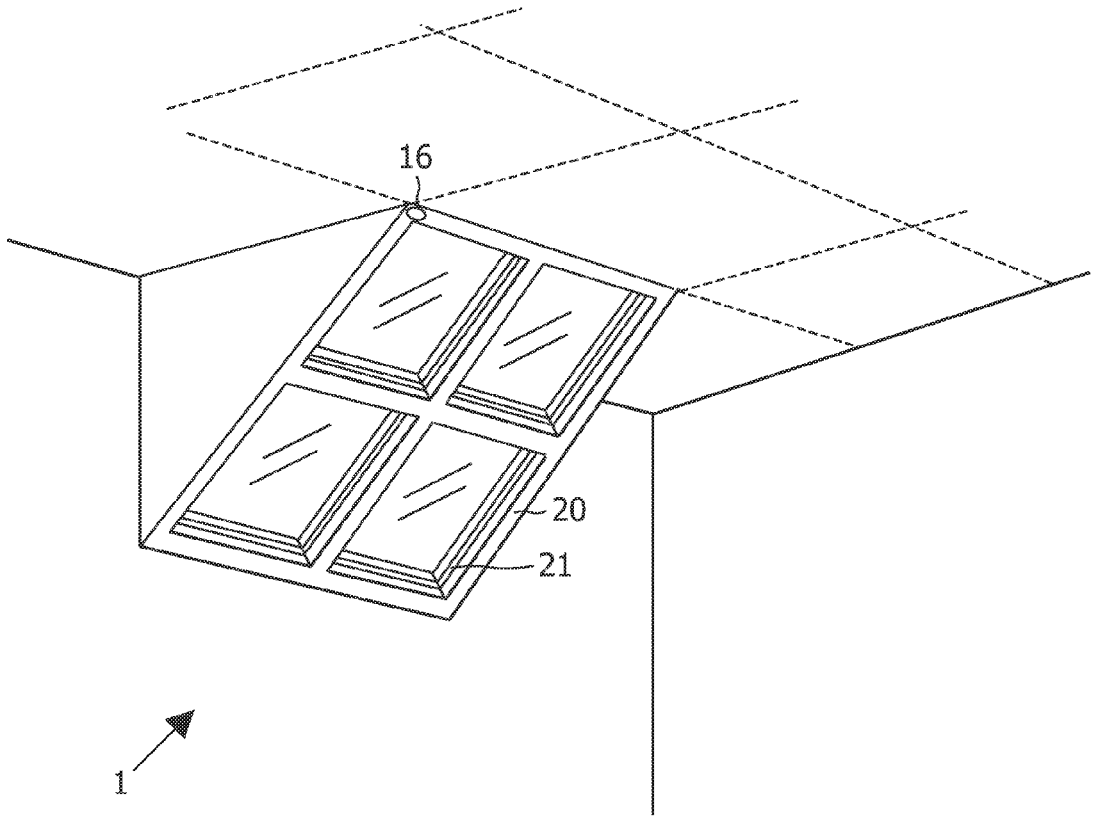
FIG. 4 is a perspective view of a second embodiment.

The embodiment of the artificial window 1 of the invention shown in FIG. 4 has a set of tubular fluorescent lamps as light sources 13 in its light box 10, behind a diffuser 14 with a spaced transparent plate 21 in front of the diffuser 14, which lamps emit red, green, and blue light during operation, as was the case in the embodiment of FIGS. 1, 2, and 3. It can be operated in the same manner as the embodiment of FIGS. 1, 2, and 3, but is shaped to fit in a corner between two constructional planes which are at right angles to one another, i.e. in a corner between a ceiling and a vertical wall. Because of its intended position, it is of interest that input can be given to the user interface 16 via a remote control device.

The invention claimed is:

1. An artificial window, comprising;

a light box having:

a rear wall;

a diffuser arrangement in front of the rear wall;

at least one first light source extending between the rear wall and the diffuser arrangement; and a first set of drivers for operating the at least one light source;

a rail extending between a first and second frame portion, said rail repositionally supporting at least one additional light source electrically connected to a second set of drivers, wherein each of the at least one additional light source radiates a spotlight-type beam, and a window frame including said first and second frame portion, said frame positioned in front of the diffuser arrangement, wherein said at least one additional light source is movable along said rail extending between said first and second frame portions adjustable to change said at least one additional light source angle with respect to said frame portions, and arranged to radiate light onto at least a portion of a front side of the diffuser arrangement facing the window frame or to radiate light through a transparent plate of the window frame.

2. The artificial window as claimed in claim 1, wherein the center of the at least one radiation beam of the at least one additional light source is aimed at the front side of the diffuser arrangement.

3. The artificial window as claimed in claim 1, wherein the direction of the radiation beam of the at least one additional light source or the position of the at least one additional light source is changeable by said driver.

4. The artificial window as claimed in claim 1, wherein the at least one additional light source is disposed between the planes of the diffuser arrangement and the window frame.

5. The artificial window as claimed in claim 1, wherein the type of the at least one additional light source is selected from the group of lamp types consisting of: HID, TL, LED, CFL, and incandescent and halogen incandescent lamps.

6. The artificial window as claimed in claim 1, further comprising a plurality of additional light sources, at least two light sources of the plurality of additional light sources belonging to different lamp types.

7. The artificial window as claimed in claim 1, wherein the at least one additional light source is of the projection type and comprises a projection lens and a slide comprising a shape, pattern, or image, said additional light source being arranged to project said shape, pattern, or image onto the diffuser arrangement.

8. The artificial window as claimed in claim 1, wherein the diffuser arrangement comprises a diffuser and a holographic foil in front of the diffuser.

9. The artificial window as claimed in claim 1, wherein a processor is present, coupled to the drivers of the light sources, so as to control the drivers in response to a signal received by a user interface.

10. The artificial window as claimed in claim 9, wherein a memory is coupled to the processor, said memory containing programs to be executed by the processor in response to a signal received by the user interface.

11. An artificial window, comprising a light box with a rear wall and a diffuser in front of said rear wall creating a gap there between;

a first light source positioned between said rear wall and said diffuser and emitting light onto said diffuser;

a first driver operably connected to said first light source;

said artificial window further having a plurality of second light sources electrically connected to a second driver, said plurality of second light sources mounted on a rail, said rail mounted along an upper portion of said artificial window and extending substantially between a first frame portion and a second frame portion;

wherein each of said second light sources illuminates individual window plates of said window frame or said diffuser;

each of said plurality of second light sources independently moveable along said rail and redirectable by said second driver to dynamically adjust each of said second light sources angle of incidence on either said window plate or said diffuser;

said first light source and said redirectable second light sources acting in conjunction to mimic exterior solar illumination of a window.

12. The artificial window of claim 11 wherein said diffuser is a opalescent polyacrylate.

* * * * *